US009555917B2

(12) United States Patent
Wong et al.

(10) Patent No.: US 9,555,917 B2
(45) Date of Patent: Jan. 31, 2017

(54) PACKAGING CONTAINER AND BLANK FOR A PACKAGING CONTAINER

(71) Applicant: Tetra Laval Holdings & Finance S.A., Pully (CH)

(72) Inventors: Allen Wong, Lund (SE); Claudia Leidinger, Malmö (SE); Christopher Scales, Copenhagen (DK); Kristian Jacobsson, Dalby (SE); Kim Walltin, Malmö (SE); Ola Wall, Lomma (SE); Torbjörn Hedberg, Lund (SE)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 0 days.

(21) Appl. No.: 14/387,449

(22) PCT Filed: Mar. 21, 2013

(86) PCT No.: PCT/EP2013/055950
§ 371 (c)(1),
(2) Date: Sep. 23, 2014

(87) PCT Pub. No.: WO2013/139917
PCT Pub. Date: Sep. 26, 2013

(65) Prior Publication Data

US 2015/0102095 A1 Apr. 16, 2015

(30) Foreign Application Priority Data

Mar. 23, 2012 (EP) ..... 12160992

(51) Int. Cl.
*B65D 5/06* (2006.01)
*B31B 1/16* (2006.01)
(Continued)

(52) U.S. Cl.
CPC ..... *B65D 5/068* (2013.01); *B31B 1/16* (2013.01); *B31B 1/88* (2013.01); *B65B 3/025* (2013.01); *B65D 5/067* (2013.01)

(58) Field of Classification Search
CPC ..... B65D 3/025; B65D 5/067; B65D 5/068
(Continued)

(56) References Cited

U.S. PATENT DOCUMENTS 3,317,107 A 5/1967 Williams
5,029,751 A * 7/1991 Detzel ..... B65D 5/06 229/116.1

(Continued)

FOREIGN PATENT DOCUMENTS

EP 1 055 606 A2 11/2000
GB 412733 A 7/1934

(Continued)

OTHER PUBLICATIONS

International Search Report (PCT/ISA/210) mailed on Jun. 24, 2013, by the European Patent Office as the International Searching Authority for International Application No. PCT/EP2013/055950.

(Continued)

*Primary Examiner* — Gary Elkins
(74) *Attorney, Agent, or Firm* — Buchanan Ingersoll & Rooney PC

(57) ABSTRACT

A gable top packaging container has a plurality of upstanding side walls including a first side wall, a front wall, a rear wall and a second side wall, wherein the front wall connects to a front gable panel and the back wall connects to a back gable panel, both extending up to a sealed top fin, the first side wall connects to a first side gable panel, and the second side wall connects to a second side gable panel, wherein the walls are separated by crease lines extending in a longitudinal direction of the packaging container, characterized in that the front wall is continuous with the front gable panel, and the back wall is continuous with the back gable panel.

20 Claims, 4 Drawing Sheets

(51) Int. Cl.
*B31B 1/88* (2006.01)
*B65B 3/02* (2006.01)

(58) Field of Classification Search
USPC ..... 229/125.42, 137, 138, 249
See application file for complete search history.

(56) References Cited

U.S. PATENT DOCUMENTS

| | | | | | |
|---|---|---|---|---|---|
| 5,803,349 | A * | 9/1998 | Ljungstrom | ..... | B65D 5/068 229/125.42 |
| D570,683 | S * | 6/2008 | Kortsmit | ..... | D9/431 |
| 7,523,853 | B2 * | 4/2009 | Kortsmit | ..... | B65D 5/067 229/108 |
| 2005/0017062 | A1 * | 1/2005 | Weintroub | ..... | B65D 5/0005 229/138 |

FOREIGN PATENT DOCUMENTS

| | | | | | |
|---|---|---|---|---|---|
| GB | 732682 | A * | 6/1955 | ..... | B65D 5/067 |
| JP | 6-1219 | U | 1/1994 | | |
| JP | 2011-143958 | A | 7/2011 | | |
| WO | WO 2006/019475 | A1 | 2/2006 | | |
| WO | WO 2007/071698 | A1 | 6/2007 | | |
| WO | 2012/156763 | A2 | 11/2012 | | |

OTHER PUBLICATIONS

Office Action issued by the Japanese Patent Office on Oct. 3, 2016 in corresponding Japanese Application No. 2015500927, and English language translation of Office Action (6 pages).

* cited by examiner

PACKAGING CONTAINER AND BLANK FOR A PACKAGING CONTAINER

TECHNICAL BACKGROUND

The present invention relates to a packaging-container blank, particularly to a packaging-container blank for a novel packaging container of a gable top type.

Gable top cartons as such have been used for quite some time and many such gable top carton appear quite similar. Typically, they have four upstanding side walls that are generally rectangular panels that are closed by a gable-shaped top. The typical gable top has equal-sized front and rear gable panels that are joined by a sealed top fin. The front panel can include a closure, such as a spout mounted to the panel to facilitate access to the contents of the carton. A threaded cap can be fitted to the spout to close the package.

After filling of the above type of containers, they are commonly loaded onto crates or similar and forwarded in the value chain, to a store, the end consumer, and recycling of the material. When loading gable top packages the sealed top fin has to be considered. Too high loads on the fin from above by bend the fin. This bending may be acceptable. Loads from above will also be distributed throughout the length of the container, with the risk of inducing structural damage to various portions of the packaging container. Presently, due care is taken during stacking of containers for this not to happen, yet a packaging container being able to withstand higher loads from the above would be advantageous.

SUMMARY OF THE INVENTION

The present invention is defined by the appended independent claims, and further embodiments thereof are defined by the corresponding dependent claims.

According to a first embodiment of the present invention a gable top packaging container comprises a bottom, a plurality of upstanding walls extending from the bottom to a sealed top fin. The upstanding walls include a first side wall adjacent to a back wall and a front wall. The front wall is adjacent to a second side wall being adjacent to the back wall. The front wall is continuous with a front gable panel via a front transition area and the back wall is continuous with a back gable panel via a back transition area. Both gable panels, the back and the front, extends to a sealed top fin, and the first side wall connects to a first side gable panel, and the second side wall connects to a second side gable panel. Adjacent upstanding walls are separated by crease lines extending in a longitudinal direction of the packaging container from the bottom to the top fin, and the front wall and the back wall follows a sloping curve in the front and back transition area respectively.

For a packaging container according to the above description focusing of forces as a result of stress from above will be avoided, since the sloping curve does not present any sharp bends through which the forces have to be transferred. In one or more embodiment it is preferred that the transition area is free from transversal crease lines.

Within the context of the present application a crease line is a fold indication which is arranged on the packaging material during converting thereof. Converting is the process in which a core of fibrous material, such as paper board, is provided with coatings, print, laminated outer layers of plastic, metal foil or etc. Generally a set of rollers with mating patterns (protrusions on one roller and mating indentations on the other) is used to compress the crease lines into the material such as to facilitate and localize folding at a later stage. The crease lines may be provided to the core before any outer layers have been laminated thereon, but they may also be provided to the material at a later stage.

In a preferred embodiment the first side gable panel is separated from the first side wall by a curved crease line, the crease line extending in a transversal direction and having a convex section, and the same is true for the second side wall and the second side gable panel.

In one or more preferred embodiments the curved crease line follows a closed path, such that the side gable panel is confined within the constraints of the two longitudinal crease lines defining the corresponding side wall and extends up towards the top fin where two ends of the curved crease line meets. This is preferably the case for both side gable panels.

In one or several embodiments it is preferred that the curved crease line has a smooth convex shape towards the delimiting longitudinal crease lines of the side panel as it passes closest to it, close to the transition area. In one or more of these embodiments the curved crease line may touch upon the longitudinal crease line, while in others there may be a defined clearance between the curved crease line and the longitudinal crease line. In this context the term "smooth" refers to a gentle curvature, as oppose to a corner or a sharp curve.

In one or more preferred embodiments the curved crease line also comprises a concave section between the smooth convex shape and the position where the two ends meet.

Though it does not have to be the case, the curved crease line is preferably symmetrical such that it is essentially mirrored in a longitudinal axis, giving the side gable panel a distinct drop shape as will be better described in the detailed description. It is preferably also centered in relation to its corresponding side wall, such that it has the same behavior in relation to longitudinal crease lines on either side of it.

In regard of the bottom of the packaging container, a sealed bottom wall is formed from a plurality of bottom wall panels, and many alternatives are known and described in prior art.

An inventive packaging container, according to one or several embodiments thereof will have properties such that a load from above will be absorbed by that container without being severely concentrated to any specific portion thereof, leaving the packaging container less prone to damage induced by top loads, thus making it less sensitive to handling. Features of the packaging container may facilitate adequate force distributions.

The present invention also relates to a blank for a packaging container according to one or more of the already mentioned embodiments. Four longitudinal crease lines, extending from a bottom to a top of the blank divides it into five panels. The first panel will when folded form the back wall and the back gable panel. The second panel is adjacent to the first panel, only being separated by the first longitudinal crease line. The second panel will when folded from a first side wall and the first side gable panel. The third panel is adjacent to the second panel, separated by the second longitudinal crease line. The third panel will when folded form the front wall and the front gable panel. The fourth panel follows next to the third panel, being separated by the third longitudinal crease line. The fourth panel will when folded form the second side wall and the second side gable panel. The fifth panel will when folded be sealed to the first panel, and is separated from the fourth panel by the fourth longitudinal crease line. A bottom creasing pattern enabling proper sealing of the bottom extends transversally over a bottom end of all panels. In regard of the bottom creasing pattern there are several known alternatives. The blank also have a top crease pattern which is localized to the side walls, said top crease pattern comprising a curved crease line extending in the transversal direction and having a convex section, bulging in the direction of the side wall (towards the bottom crease pattern). In one or more preferred embodiments the curved crease line follows a closed path, such that the side gable panel is confined within the constraints of the two longitudinal crease lines defining the corresponding side wall and extends up towards the top fin where two ends of the curved crease line meets. This is preferably the case for both side gable panels.

A "blank" is well-known to the skilled person, and should be construed as a piece of packaging material which is configured to be folded into a packaging container by being cut into a suitable shape and provided with suitable crease lines. The exact shape of a blank will vary with the type of packaging container it relates to, yet it is common that the blank is a generally rectangular shape, and it may also be folded and sealed such as to form a flattened sleeve (a packaging container with an open to a bottom). The blank is delivered to a filling machine in which is filled with its contents and sealed.

In one or several embodiments it is preferred that the curved crease line has a smooth convex shape towards the delimiting longitudinal crease lines of the side panel as it passes closest to it. In one or more of these embodiments the curved crease line may touch upon the longitudinal crease line, while in others there may be a defined clearance between the curved crease line and the longitudinal crease line.

In one or more preferred embodiments the curved crease line also comprises a concave section between the smooth convex shape (area B in the detailed description) and the position where the two ends meet. In this way an S-shape will be created.

Though it does not have to be the case, the curved crease line is preferably symmetrical such that it is essentially mirrored in a longitudinal axis, giving the side gable panel a distinct drop shape as will be better described in the detailed description. It is preferably also centered in relation to its corresponding side wall, such that it has the same behavior in relation to longitudinal crease lines on either side of it.

According to another aspect, the present invention also relates to a method for manufacturing an inventive packaging blank. The method comprises the steps of providing web of packaging material with a crease pattern, cutting the packaging material into separate blanks.

The above stated steps may be preceded by the one or more of the steps of providing a web of packaging material with a coating (such as a clay based material) laminating further layers onto the web of packaging material (such as polyethylene and/or aluminium foil). In this context laponite, kaolinite, dickite, nacrite, halloysite, antigorite, chrysolite, pyrophyllite, montmorillonite, hectorite, sodium tetrasilicic mica, sodium taeniolite, commonmica, margarite, vermiculite, phlogophite, xanthophyllite and the like may be mentioned as suitable clay minerals. The material may also be provided with a print prior to creasing and cutting it into individual blanks.

According to yet another aspect the present invention also relates to a method for manufacturing and filling an inventive gable-top packaging container. The method comprises the steps of rising the blank from a flat shape to the shape of a packaging container having an open top and bottom, arranging the risen blank on a mandrel, folding and sealing one end, the top or the bottom, of the packaging container, sterilizing an interior of the packaging container, filling the packaging container, folding and sealing another end, the bottom or the top, of the packaging container. In this embodiment the longitudinal edges of the blank has first been sealed, such as to form a sleeve. When the blank is risen from this state it will this form a tube, having a rectangular cross section, and both the bottom end and the top end will be open, as is specified above.

Additional embodiments of the present invention will be disclosed in the detailed description which is to follow. Though several individual embodiments will be described, it should be obvious to the skilled person that these embodiments are provided for explaining particular features of enabled within the scope of the present invention, and unless physically impossible features from different embodiments may be readily combined, which is also true for the embodiments previously described.

DETAILED DESCRIPTION OF EMBODIMENTS

Figure 1:
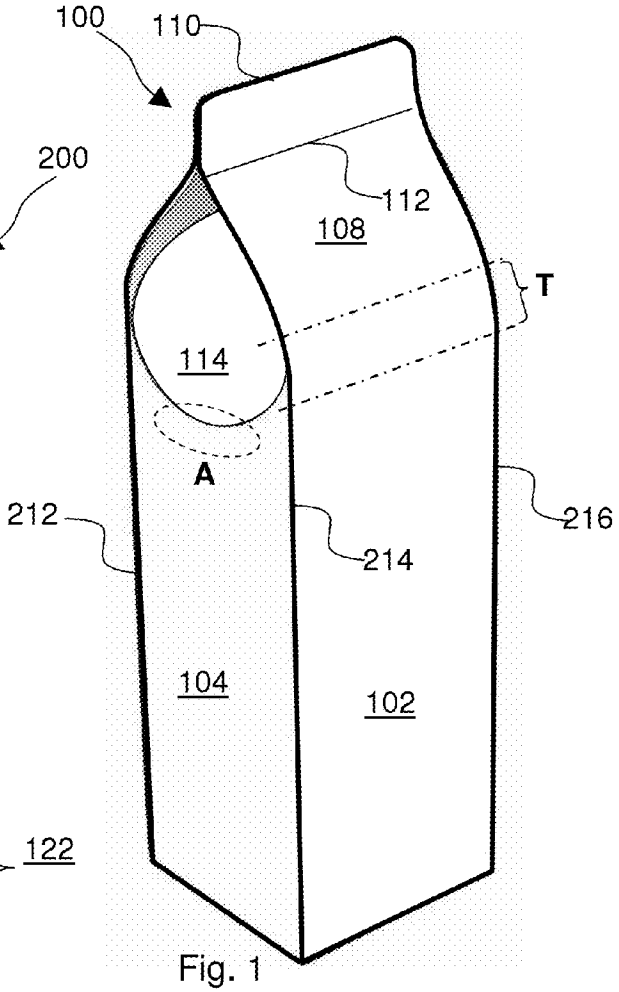
FIG. 1 is a perspective view of a packaging container according to one embodiment of the present invention.

FIG. 1 is a perspective view of a packaging container 100 in accordance with a first embodiment of the present invention. In this particular embodiment the packaging container is symmetrical, such that even if only a front wall 102 and a first side wall 104 is shown, it is to be understood that a corresponding view showing the back wall 106 (shown in FIG. 2) and the second side wall 105 (also shown in FIG. 2) instead would look essentially the same. The same goes for gable panels, etc. in that panels and details on one side of the packaging container will have same appearance on an opposite side of the packaging container. This general rule does not apply to the top and bottom, which may considered as opposite sides yet which do not have a similar appearance.

The front wall 102 is continuous with the front gable panel 108 via a curved transition area T, and the front gable panel in connects to the sealed top fin 110. A transversal crease line 112 separates the front gable panel 108 from the sealed top fin 110, while the front wall as such 102 is continuous with the front gable panel 108, i.e. they are not separated by a crease line in the curved transition area T. The transversal crease line 112 between the front gable panel 108 and the sealed top fin 110 is preferred for most embodiments, yet it may be left out if desired. Moving on, the first side wall 104 is separated from a first side gable panel 114 by means of a curved crease line 116 comprising a convex section A bulging towards the bottom of the packaging container 100. Convex in this context implies that the curved crease line 116 follows a smooth curve, which bulges outwards from the first side gable panel 114 and for the present section outwards corresponds to a direction towards the bottom of the packaging container. The curved crease line 116 also comprises a convex section in the area B where it is closest to a longitudinal crease line 212 (and 214) for that matter. Following an analogous terminology this corresponds to the curved crease line bulging outwards towards an adjacent longitudinal crease line. Further features of the curved crease line 116 will be described in relation to FIGS. 2-10.

One or more embodiments the longitudinal crease lines 212, 214 etc may have a curved shape. Further, the back wall 106 and the front wall 102 may be divided into more walls by use of further longitudinal crease lines.

A description of the back wall 106 and back gable panel would correspond to the above description of the front wall 102 and the front gable panel 108, and a description of the second side wall and the second side gable panel would correspond to the above description of the first side wall and the first side gable panel.

In a further embodiment the front wall and the front gable panel may be separated by a transversal crease line, and the same goes for the back panel. This approach may be used for any of the described embodiments, and in particular embodiments where the side gable panels have the defined curved shape since sections of the curved shape may be used to guide the shape of the front wall/back wall in their transition to the front wall panel/back wall panel. Such guidance may result in that the presence of a transversal crease line in the transition area T still would not have to result in a sharp corner of the container.

Features of the various sides of the packaging container are easily understood from studying features of a blank 200 from which the package is formed.

Figure 2:
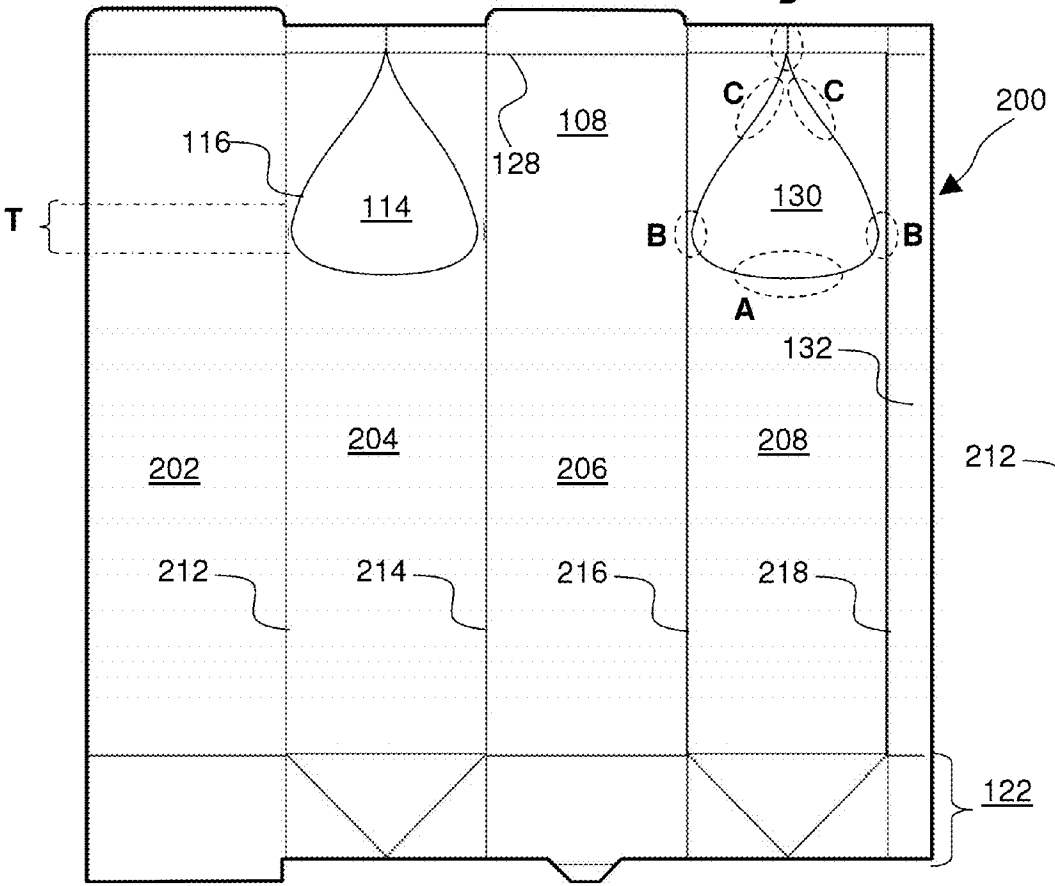
FIG. 2 is a planar view of a blank for a packaging container in accordance with one embodiment of the present invention.

The blank 200 for a packaging container according to one embodiment of the present invention is shown in the view of FIG. 2. On the lower portion of the blank 200 a bottom sealing pattern 122 is located. A longitudinal direction corresponds to a direction from the bottom edge of the blank towards a top edge of the blank, corresponding to the natural longitudinal direction of a packaging container formed from the blank. The transversal direction is consequently at right angles to the longitudinal direction, in the plane of the blank, i.e. in the conventional way. The particular layout of the bottom sealing pattern 122 is not the focus of the present invention, and the bottom sealing pattern illustrated in FIG. 2 has been previously presented in e.g. WO 2006/019475.

Four longitudinal crease lines 212, 214, 216, 218, extending from a bottom edge to a top edge of the blank 200, divides the blank into five panels. The first panel 202 will when folded form the back wall and the back gable panel, and therefore preferably consists of a continuous area not divided by crease lines. The second panel 204 is adjacent to the first panel 202, and the first longitudinal crease line 212 separates the two. The second panel 204 will when folded from a first side wall and the first side gable panel and has a creasing pattern, the curved crease line 116, separating the two panels. This curved crease line 116 forms part of the top crease pattern. The third panel 206 is adjacent to the second panel 204, separated by the second longitudinal crease line 214. The third panel 206 will when folded form the front wall and the front gable panel, and consequently the properties of the third panel 206 corresponds to those of the first panel 202. The fourth panel 208 follows next to the third panel 206, being separated therefrom by the third longitudinal crease line 216. The fourth panel 208 will when folded form the second side wall and the second side gable panel. The fifth 210 panel will eventually be sealed to the first panel 202, and it is separated from the fourth panel 208 by the fourth longitudinal crease line 218. The fifth panel will not be visible on the exterior of the formed packaging container, it is merely used to seal towards the interior of the first panel 202, to partly form the packaging container, i.e. a sleeve having two open ends later to form the top and bottom of the packaging container. The blank also have a top crease pattern which is localized to the second panel 204 and the fourth panel 208, said top crease pattern comprising a curved crease line 116 on each one of the second and the fourth panel respectively, as mentioned earlier.

A portion forming the top fin 110 of the package when folded is defined by the upper edge of the blank and a transversal crease line 128 (in part corresponding to crease line 112 of FIG. 1) and the longitudinal crease lines 212-218 extends into this portion, indicating folding positions of this portion too. The particular form and arrangement of crease lines in relation to the top fin will not be discussed in any further detail.

The portions of the blank which will form the front wall 102, the back wall 106, the first side wall 104 and the second side wall 105 are clearly seen in FIG. 2. The front gable panel 108 and the back gable panel 128 are not as easily spotted, since they are continuous with the front wall and the back wall respectively, continuous implying that they are not separated by a crease line. The curved crease line 116 reveals the position of the first side gable panel 114, and the second side gable panel 130, respectively, the two being identical in size and shape. Features of the curved crease line already mentioned in relation to FIG. 1 will not be repeated, while the corresponding denotation will be used in FIG. 2. The two areas A and B are only denoted in one of the side gable panels, yet they same features apply for the second side gable panel. Also shown is a concave section C, located between the area B and a position D where the two ends of the curved crease line 116 meet, which area also corresponds to the location of a longitudinal crease line of the top fin. The concave shape of the section C combines with the convex shape in area B gives the crease line an S-shape from area B to position D. A discontinuity of the curved crease line 116, if any, may be present in the area B, and in one or more embodiment the curved crease line may also (or instead) touch or partly join with the longitudinal crease line in this area, some examples of which is illustrated in FIGS. 3-7. In the illustrated embodiment, however, the curved crease line 116 is continuous throughout the area B and there is also a clearance between the curved crease line 116 and the nearby longitudinal crease line in this area, i.e. 212 and 214. In the case where there is a discontinuity in the area B, the curved crease line 116 may be said to comprise two portions, an upper and a lower, having a clearance between the upper and the lower portion in a lateral region of the drop shape. An example of this would be that the crease line 116 would be missing in the area B of FIG. 2, to be closer described in the following.

Figure 3:
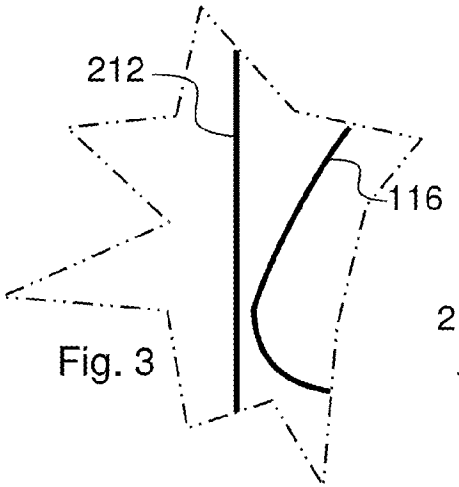
FIGS. 3-10 are detailed partial views of a creasing pattern as used in embodiments of the present invention.
Figure 4:
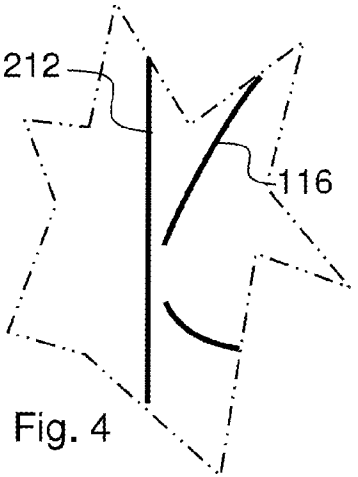
Figure 5:
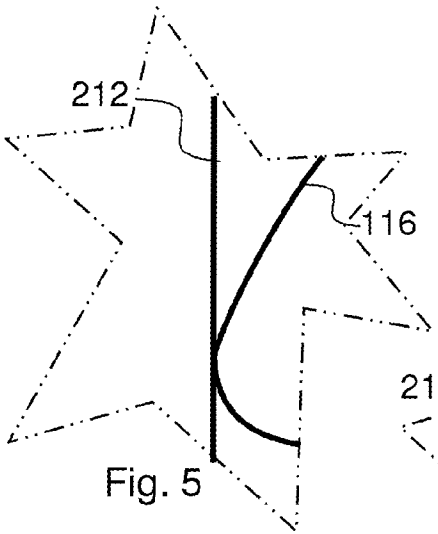
Figure 6:
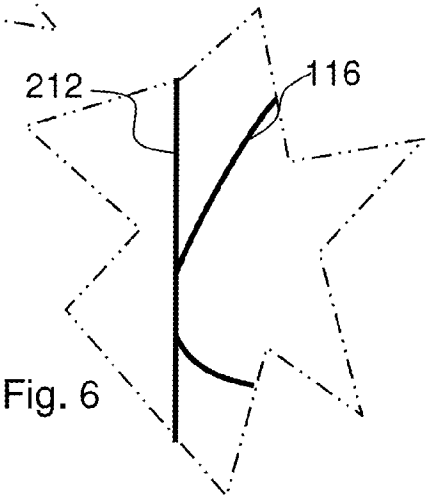
Figure 9:
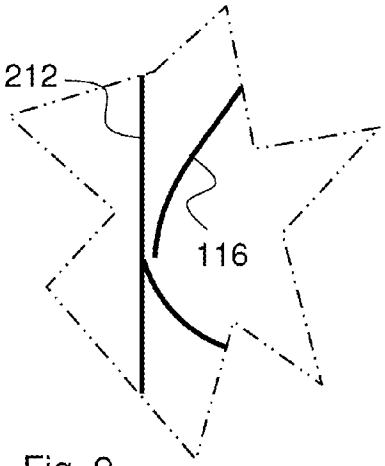
Figure 10:
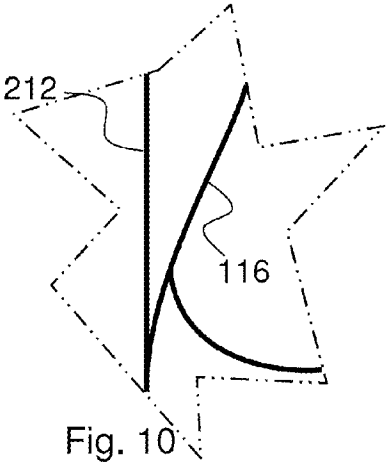
Figure 7:
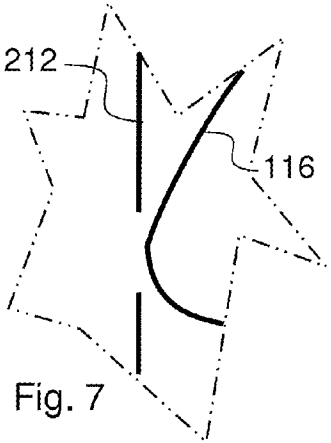
Figure 8:
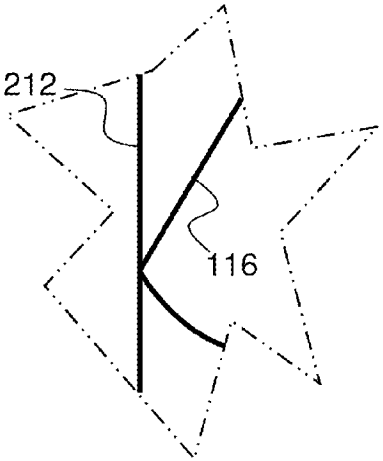

FIGS. 3-10 illustrate schematically various layouts for the region B, i.e. the region where the curved crease line 116 (or 130) is the closest to an adjacent longitudinal crease line. The drawings are partial and schematic, yet by comparison with FIG. 2 the full appearance should be readily appreciated. Only one side of one curved crease line is shown, however, the general assumption is that the other side of the curved creased line has an identical layout. Though it is not a must, it is usually preferred that both curved crease lines, that is both side gable panels of the package is identical, for symmetrical reasons. FIG. 3 shows a layout similar to the one of FIG. 2 the curved crease line 116 and the longitudinal crease line 212 share a common area, but they never meet. In FIG. 4 the curved crease line is instead discontinuous in the area closest to the longitudinal crease line 212, and still the crease lines to not meet. This allows for some degree of freedom in the step of folding the blank into a package in that it for a short distance does not have to follow the curved creasing line, and it also removes the smallest tapered portions of packaging material between adjacent crease lines, which is most easily recognized by comparing FIG. 4 with the embodiment of FIG. 5. In FIG. 5 the crease lines again share a common area, and in this example the curved crease line 116 even touches upon the longitudinal crease line 212 such that they share paths for a short distance. This layout eliminates the clearance between the curved crease line and the longitudinal crease line. A further example, shown in FIG. 6 corresponds to having a discontinuous curved crease line 116 like in FIG. 4, yet allowing the curved crease line 116 to meet with the longitudinal crease line 212. In this example the crease lines share paths for a longer distance than in the previous embodiment. In this layout the curved crease line will diverge from the longitudinal crease line at a shallower angle, when leaving the common path. In the example of FIG. 7 the longitudinal crease line is discontinuous while the curved crease line 116 is continuous, and the benefit of this arrangement is similar to that of FIG. 4. FIG. 8 illustrates a slightly simplified crease pattern, in which the lower portion of the crease line 116 has a curved arcuate shape bulging into the sidewall, while the upper portion is rectilinear. In variations on this theme the upper portion may instead have an S-shape to achieve the associated advantages as described earlier, or follow a concave or convex curve, yet it would then transform into one of the embodiments disclosed above and or below. In the embodiment of FIG. 9, there is again a discontinuity in the crease line 116, wherein the upper part is shifted inwards, away from the longitudinal crease line 212 such that a clearance is formed between a lowermost end of the upper portion of the crease line 116, while the lower portion of the crease line 116 extends fully to the longitudinal crease line 212. In the specific embodiment shown there is only a lateral shift, such that the lower portion begins where the upper portion ends in a longitudinal direction while a gap is formed in the vertical direction, as is best shown in the illustrative view of FIG. 9. Also in this embodiment the shape of the upper portion may vary between the shapes already described, i.e. rectilinear, concave/convex or S-shaped. It is to be noted that the S-shape does not have to be pronounced in order to fulfill its purpose, even though there may be variations of the effect depending on the shape. In the embodiment of FIG. 10 the upper portion of the crease line 116 extends all the way to the longitudinal crease line 212 along a continuous path, which preferably but not necessarily is S-shaped. The lower portion of the crease line 116 connects to the upper portion at a distance from the longitudinal crease line 212, thus forming the characteristic shape shown in FIG. 10.

Variations in crease pattern in this region B may affect the overall stability of the packaging container but that is not the sole purpose since it may also affect the design and appearance of the packaging container. The impact of the crease pattern on these two areas (the stability and the design) may also vary with the type of material used, e.g. a thinner, less rigid material may be more prone to accept a crease pattern resulting in small clearances between adjacent crease lines and areas of narrow angles, than what is the case for a thicker and more rigid material. It should also be emphasized that the variations performed in the well defined region B is not intended to alter the overall impression of the package design, merely accomplish an optimized effect on a detail level. It may also be noticed that for all embodiments the overall convex appearance prevails.

Figure 12:
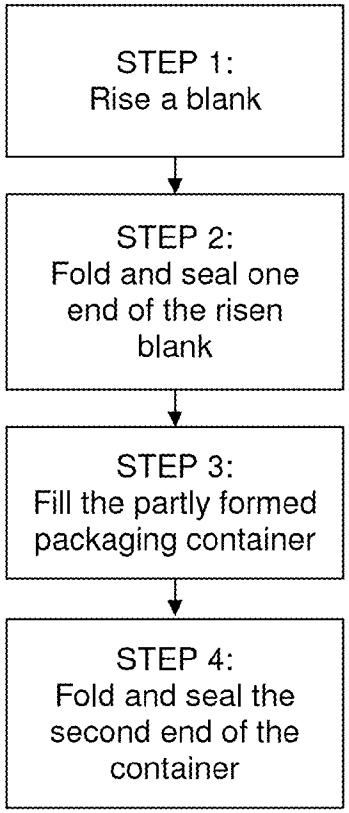
FIG. 12 is a flow chart of an embodiment of a method for manufacturing a packaging container from a blank, according to another aspect of the present invention.
Figure 11:
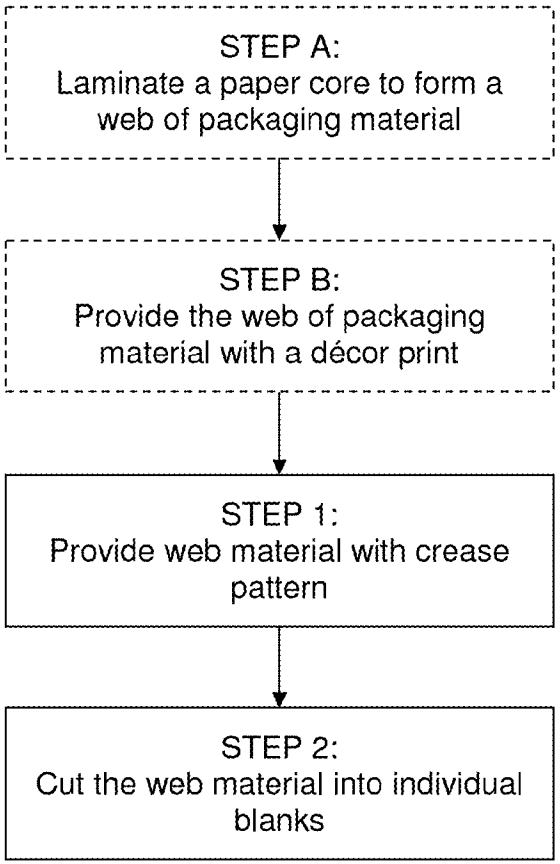
FIG. 11 is a flow chart of an embodiment of a method for manufacturing a blank, according to one aspect of the present invention.

A method for forming a blank, and a method for forming a packaging container from a blank, respectively, is shown in FIG. 11 and FIG. 12, respectively.

Thus far the material used in the web of packaging material (and consequently in the packaging container as well as the blank) has not been discussed. It is preferred that the material is a packaging laminate made from a paper board another fibrous core layer, preferably made from recyclable material, interposed with one or more layers of plastic, such as LDPE. The laminate may include further barrier layers, such as aluminum for prevention of passage of oxygen and/or light through the packaging container, as well as layers used for attaching separate layers to each other. There are many other types of laminates used for the purpose of forming packaging containers. This is well known to the skilled person and the present invention, as defined by the claims, should not be limited to this particular example.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated. Generally, making small alterations in the curved creasing line, such as leaving small segments non-creased should be considered as forming part of the present invention according to the previous description, unless relevant prior art prevents this broadened interpretation. Further, the lower convex segment may involve additional convex and concave segments of the same curve, arranged in an alternating fashion.

All patents referred to herein, are hereby incorporated herein by reference, whether or not specifically done so within the text of this disclosure. In the present disclosure, the words "a" or "an" are to be taken to include both the singular and the plural. Conversely, any reference to plural items shall, where appropriate, include the singular. When used herein a "drop shape" is defined as a two-dimensional shape having a semicircular or semielliptical lower portion and a curved, tapered upper portion, i.e. the present definition remains within the conventional definition of a stylized drop.

From the foregoing it will be observed that numerous modifications and variations can be effectuated without departing from the true spirit and scope of the novel concepts of the present invention, it is to be understood that no limitation with respect to the specific embodiments illustrated is intended or should be inferred. The disclosure is intended to cover by the appended claims all such modifications as fall within the scope of the claims.

The invention claimed is:

1. A gable top packaging container comprising a bottom, a plurality of upstanding walls extending from the bottom to a sealed top fin, said upstanding walls including a first side wall adjacent to a back wall and to a front wall, said front wall being adjacent to a second side wall, said second side wall being adjacent to said back wall, wherein the front wall is continuous with a front gable panel via a front transition area and the back wall is continuous with a back gable panel via a back transition area, the front wall and the back wall extend to the sealed top fin, the first side wall connects to a first side gable panel, and the second side wall connects to a second side gable panel, wherein adjacent upstanding walls are separated by longitudinal crease lines extending in a longitudinal direction of the packaging container, wherein the front wall and the back wall each follow a sloping curve in the front and back transition area respectively, the longitudinal crease lines including a first longitudinal crease line separating the first side wall from the front wall, and a second longitudinal crease line separating the first side wall from the back wall, the first side gable panel being separated from the first side wall by a curved crease line, and the curved crease line being spaced from the first longitudinal crease line and the second longitudinal crease line.

2. The gable top packaging container of claim 1, wherein the curved crease line extends in a transversal direction of the packaging container and having at least one convex section, bulging towards the bottom of the container.

3. The gable top packaging container of claim 2, wherein the curved crease line follows a closed path, such that the side gable panel is confined within the constraints of the first and second longitudinal crease lines and extends up towards the top fin where two ends of the curved crease line meets.

4. The gable top packaging container of claim 2, wherein, in an area in which the curved crease line is the closest to one of the first longitudinal crease line and the second longitudinal crease line, a behavior of the curved crease line is selected from the group comprising: the curved crease line has a curved convex shape towards the one longitudinal crease line; the curved crease line has a discontinuity; the one longitudinal crease line has a discontinuity; or any combination thereof.

5. The gable top packaging container of claim 4, wherein the curved crease line comprises a concave section between a position where the two ends meet and an area in which the curved crease line is closest to the one longitudinal crease line.

6. The gable top packaging container of claim 1, wherein the curved crease line is symmetrical, such that it is mirrored in a longitudinal axis.

7. The gable top packaging container of claim 1, wherein the second side gable panel has an identical curved crease line as the first side gable panel.

8. A blank configured to be folded into a gable-top packaging container comprised of a bottom, a sealed top fin and plural upstanding walls extending from the bottom to the sealed top fin, the upstanding walls including a first side wall adjacent to a back wall and adjacent to a front wall, the front wall being adjacent to a second side wall, the second side wall being adjacent to the back wall, the blank comprising:

four longitudinal crease lines extending from a bottom edge to a top edge of the blank, the four longitudinal crease lines dividing the blank into five panels, the five panels comprising a first panel, a second panel, a third panel, a fourth panel and a fifth panel;

the first panel comprising a continuous area not divided by crease lines and which, when folded, forms the back wall, a back gable panel and a transition area between the back wall and the back gable panel;

the second panel being adjacent to the first panel and being separated from the first panel by a first of the longitudinal crease lines, the second panel, when folded, forming the first side wall and a first side gable panel;

the third panel being adjacent to the second panel and being separated from the second panel by a second of the longitudinal crease lines, the third panel comprising a continuous area not divided by crease lines and which, when folded forms the front wall, a front gable panel, and a transition area between the front wall and a front gable panel;

the fourth panel being adjacent to the third panel and being separated from the third panel by a third of the longitudinal crease lines, the fourth panel, when folded, forming the second side wall and a second side gable panel;

the fifth panel being separated from the fourth panel by a fourth of the longitudinal crease lines, the fifth panel being configured to be sealed to the first panel during formation of the gable-top packaging container;

the first side gable panel being separated from the first side wall by a curved crease line, and the curved crease line being spaced from the first longitudinal crease line and the second longitudinal crease line.

9. A method for manufacturing a blank of claim 8, comprising:

providing web of packaging material with a crease pattern, cutting the web of packaging material into separate blanks.

10. The method of claim 9, preceded by forming the web of packaging material from a paper core provided with laminated layers of material, providing the thus formed web of packaging material with a print onto one side thereof.

11. A method for manufacturing a gable-top packaging container of claim 1, comprising:

rising a blank from a flat shape to a packaging container shape having an open top and a bottom end, arranging the risen blank on a mandrel, folding and sealing one of the top end and the bottom end of the packaging container, sterilizing an interior of the packaging container, filling the packaging container, and folding and sealing the other one of the bottom end and the top end to form the packaging container.

12. Method of using the packaging blank according to claim 8, to form the gable-top packaging container, the method comprising:

folding the blank along the first crease line, the second crease line, the third crease line, the fourth crease line and the fifth crease line, and folding the second panel and the fourth panel, to form the first side wall, the first side gable panel, the front wall, the front gable panel, the second side wall and the second side gable panel; and sealing the first panel and the fifth panel together.

13. The blank of claim 8, wherein the second panel and/or the fourth panel comprises a top crease pattern in the form of a curved crease line extending in the transversal direction and having a convex section, bulging in a direction of the bottom edge.

14. The blank of claim 8, wherein the curved crease line follows a closed path such that the first side gable panel is confined within the constraints of the first and second longitudinal crease lines and extends up towards the top edge where two ends of the curved crease line meet.

15. The blank of claim 8, wherein in an area in which the curved crease line is closest to one of the first longitudinal crease line and the second longitudinal crease line, a behavior of the curved crease line is selected from the group comprising: the curved crease line has a curved convex shape towards the one longitudinal crease line; the curved crease line has a discontinuity; the longitudinal crease line has a discontinuity; or any combination thereof.

16. The blank of claim 15, wherein the curved crease line comprises a concave section between a position where two ends of the curved crease line meet and an area in which the curved crease line is closest to the one longitudinal crease line.

17. The blank of claim 8, wherein the curved crease line is symmetrical, such that it is mirrored in a longitudinal axis.

18. The blank of claim 8, wherein the second side gable panel has an identical curved crease line as the first side gable panel.

19. The blank of claim 8, wherein the curved crease line comprises a concave section between a position where two ends of the first curved crease line meet and an area in which the first curved crease line is the closest to one of the first and second crease lines.

20. The blank of claim 8, wherein the curved crease line is symmetrical such that the curved crease line is mirrored in a longitudinal axis, so that the first side gable panel possesses a drop shape.

* * * * *